United States Patent [19]

Hölss

[11] Patent Number: 5,017,106

[45] Date of Patent: May 21, 1991

[54] PUMP FOR CONVEYING GASES AND PROVIDING A DIFFERENTIAL PRESSURE

[75] Inventor: Kurt Hölss, Hüttenberg, Fed. Rep. of Germany

[73] Assignee: Arthur Pfeiffer Vakuumtechnik Wetzlar GmbH

[21] Appl. No.: 508,266

[22] Filed: Apr. 11, 1990

[30] Foreign Application Priority Data

Apr. 28, 1989 [DE] Fed. Rep. of Germany ..... 3914042

[51] Int. Cl.[5] ..... F04C 21/00

[52] U.S. Cl. ..... 417/481; 92/122

[58] Field of Search ..... 417/481, 521, 533, 423.9, 417/482, 483, 484; 92/122, 121

[56] References Cited

U.S. PATENT DOCUMENTS 3,731,599 5/1973 Allen ..... 92/122

FOREIGN PATENT DOCUMENTS 829554 1/1952 Fed. Rep. of Germany .

2613472 10/1977 Fed. Rep. of Germany .

*Primary Examiner*—Michael Koczo
*Assistant Examiner*—Charles Freay, Jr.
*Attorney, Agent, or Firm*—Toren, McGeady & Associates

[57] ABSTRACT

In pumps for conveying gases and providing a differential pressure between the pump inlet and outlet, a pumping space within the pump is hermetically sealed from the pump drive unit. No oil or grease-lubricated parts are located within the pumping space. Accordingly, the pump can be characterized as completely dry running. The hermetical seal is provided by a hollow or tubular member (5) capable of torsion movement and located between a shaft (1) and a container (6). A drive unit (7) connected to the shaft provides it with an oscillating rotary motion transmitted through the shaft to the container (6). Segmented pistons (8*a*, 8*b*) are located on the container and oscillate in the pumping space between stationary parts (10*a*, 10*b*) and afford the pumping effect.

6 Claims, 4 Drawing Sheets

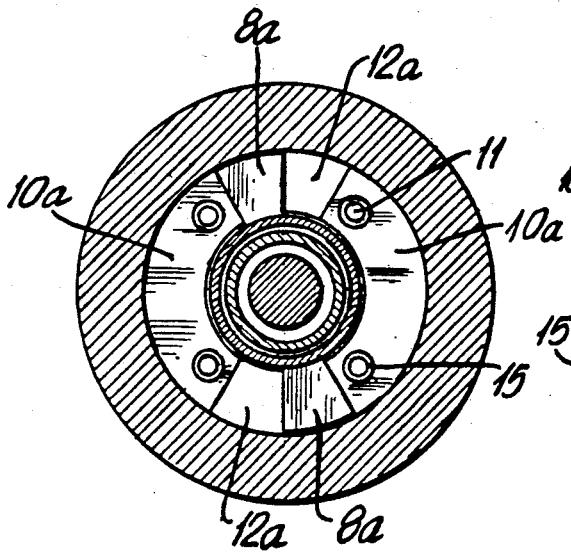
FIG.5a1
t1
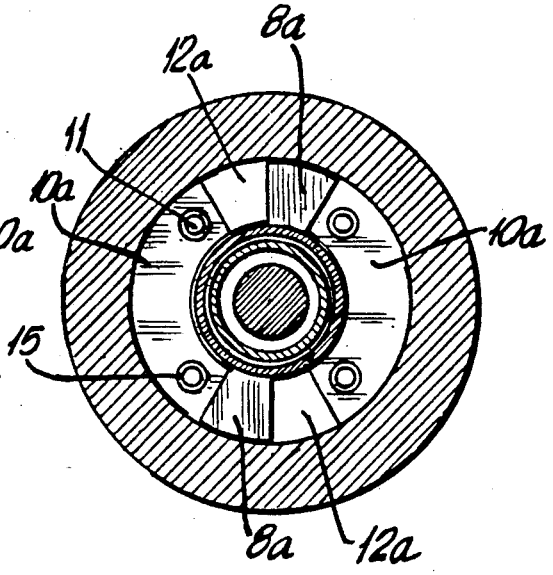
FIG.5a2
t1
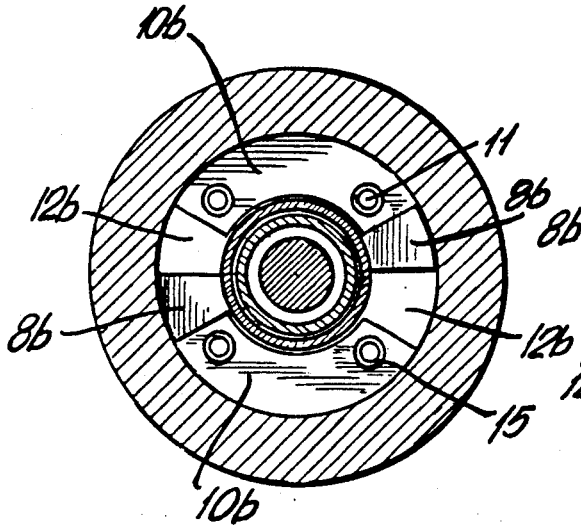
FIG.5b1
t2
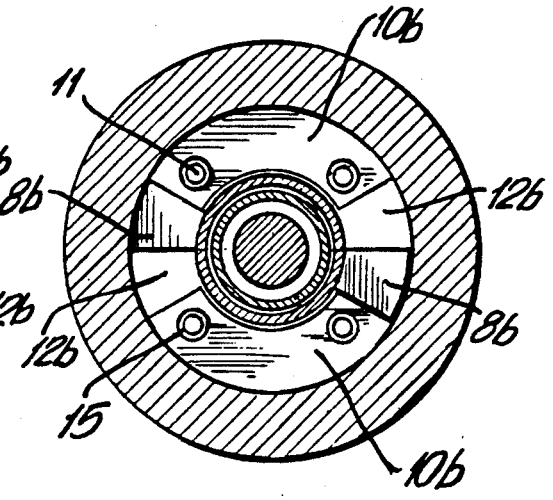
FIG.5b2
t2

PUMP FOR CONVEYING GASES AND PROVIDING A DIFFERENTIAL PRESSURE

BACKGROUND OF THE INVENTION

The present invention is directed to a pump for conveying gases and providing a differential pressure between a pump inlet and a pump outlet. Oil or grease lubricated parts are not located within the pumping space, accordingly, it can be characterized as a completely dry running pump.

In the production of a high vacuum or ultra high vacuum, a hydrocarbon-free residual gas atmosphere is required in many cases. For the most part, the known so-called "dry pump systems", such as ion getter pumps, sublimation pumps, cryogenic pumps and tubular turbo-molecular pumps, are used. In such pump systems for the positive elimination of contamination by hydrocarbons, it is helpful to avoid oil lubricated or oil sealed back-up or fore-pumps for the pre-evacuation of atmospheric pressure up to the point of using these dry running pumps.

It has been known to use mechanical back-up pumps, such as piston valves with dry running carbon slides or Roots type pumps, where the use of hydrocarbons as sealing means in the delivery chamber are avoided. As long as lubricated bearings are used in these pumps, there is no complete security against the escape of lubricant, even if the bearing locations are sealed against the delivery chamber by conventional sealing packing. A perfect solution is obtained only when a gas-tight separation of the bearing systems from the suction space is obtained. Basically, diaphragm pumps can be used to obtain an oil-free vacuum, such pumps, however, have a very limited useful life, due to the considerable deformation of the diaphragm. Moreover, the tandem arrangement of several pumping stages is expensive.

Furthermore, sorption pumps can be used, however, such pumps have an adequate efficiency only if a cooling agent is used, such as liquid nitrogen. These pumps also require regeneration and, as a result, are cumbersome in handling. Therefore, they are less suitable for use in industrial applications, where at the present time automation of the pumping process is in increasing demand.

SUMMARY OF THE INVENTION

The primary object of the present invention is to provide a vacuum pump working against atmospheric pressure where the pumping space is completely dry. The disadvantages experienced in known dry pump systems can be avoided. To limit the gas back-feed flow to a minimum, an area-type seal between the moving and stationary parts is desired. The harmful space is kept as small as possible in view of the high pressure ratio.

In accordance with the present invention, the pump shaft is enclosed by a container, a pumping space is located outwardly about the container, and a tubular member capable of torsional movement is provided between the shaft and the container for providing a hermetical seal between the drive unit for the shaft and the pumping space.

In a preferred arrangement, pistons in the shape of segments are secured to the outside surface of the container and cooperate with stationary parts, preferably in the shape of segments, located between the pistons so that the pumping spaces are located between the movable pistons on the container and the stationary parts.

Accordingly, a pump system is provided which is completely dry inside the pumping space with the pumping space being hermetically sealed from the driving unit. Because of the hollow member capable of torsional movement being subject to a relatively low mechanical stress, a longer useful life than found in other pumps with deformable parts, such as diaphragm pumps, can be achieved. An area-tight seal is present between the moving and stationary parts in the pumping space, whereby gas back-feed or return flow is limited to a minimum.

This harmful space is kept to a minimum favoring the build up of a high pressure ratio. The design of multistage versions can be attained without any problems. The pump can be used for producing an underpressure as well as for producing an overpressure.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

Figure 1:
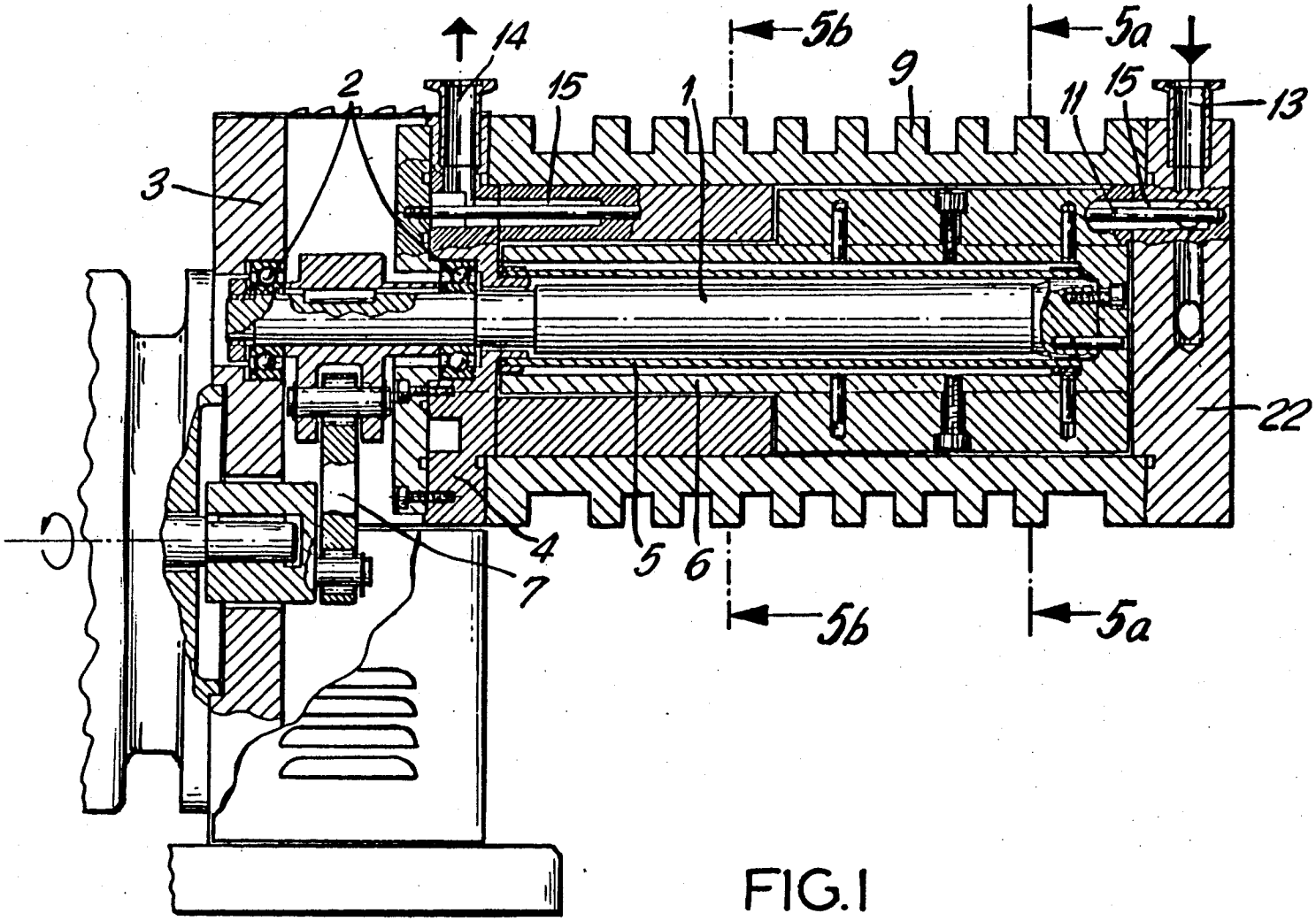
FIG. 1 is an axially extending sectional view through a pump embodying the present invention.

FIGS. $5a_1$ and $5a_2$ are cross-sectional views taken along line 5*a*—5*a* in FIG. 1 at the instants $t_1$ and $t_2$, respectively; and FIGS. $5b_1$ and $5b_2$ are cross-sectional views taken along the line 5*b*—5*b* in FIG. 1 at the instants $t_1$ and $t_2$, respectively.

DETAILED DESCRIPTION OF THE INVENTION

Figure 2:
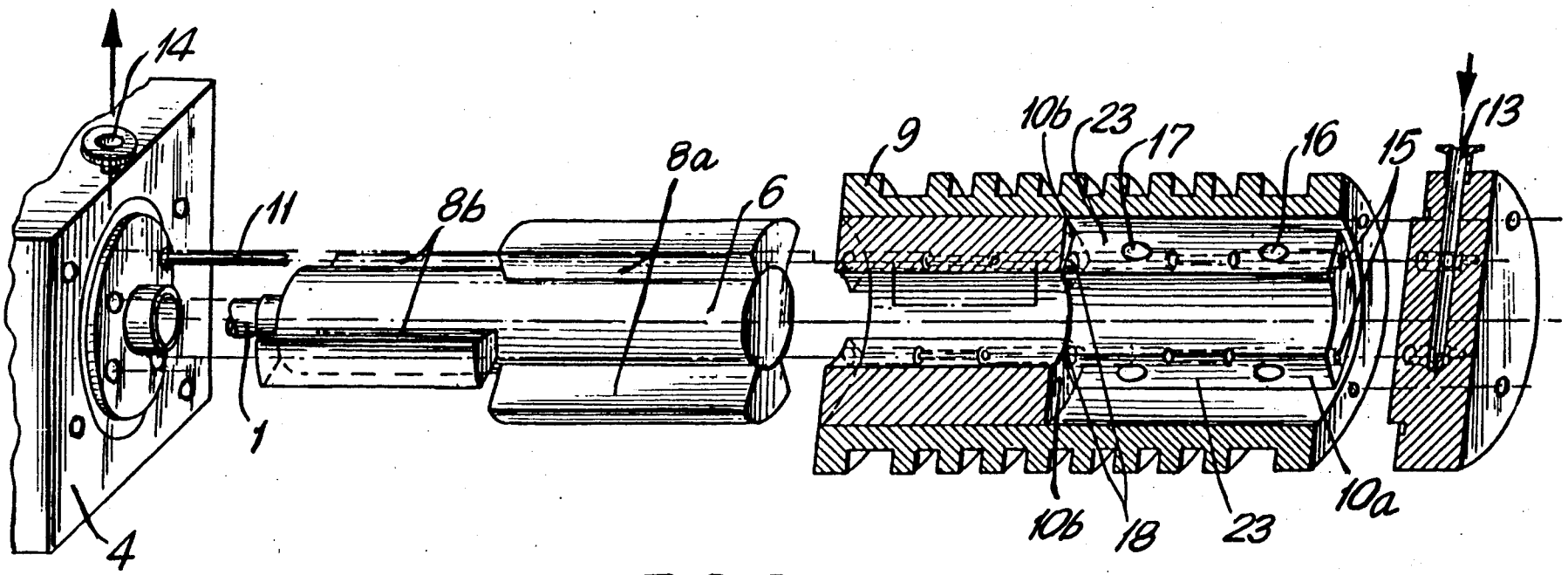
FIG. 2 is an exploded view, partly in section, of the pump shown in FIG. 1.
Figure 4:
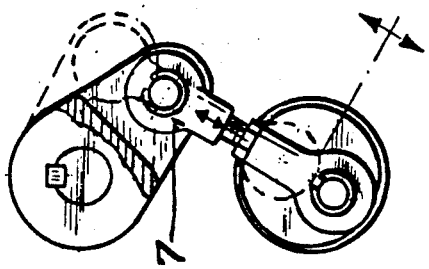
FIG. 4 is a view, partly in section, of a crank drive for the pump.

In FIG. 1, a pump is illustrated having an axially elongated shaft 1, supported at one end on two ball bearings 2 spaced apart in the axial direction. As a result, the shaft 1 is supported in a cantilevered manner. The ball bearings 2 are secured in place by a pair of spaced flanges 3, 4. An axially extending hollow member 5 capable of torsional movement is fastened in a vacuum-tight manner at the opposite end of the shaft from the bearings. The hollow member can be a metal sleeve, as shown in the drawing a rubber or plastic hose, or a corrugated tube. The hollow member 5 extends from the flange 4 to the opposite end of the shaft. An axially extending container 6 closed at one end laterally encircles the hollow member 5 and is fastened to the end of the shaft 1 opposite the end supported by the ball bearings. Shaft 1 receives an oscillating rotary motion from a driving unit 7, note FIGS. 1 and 4. Container 6 has a radially inner surface facing the hollow member 5 and the shaft 1, and a radially outer surface facing in the opposite direction. Segment pistons 8*a*, 8*b* (in the illustrated embodiment of FIG. 1 there are two such pistons) fastened as shown in FIG. 2 on the outer surface of the container 6. The container 6 and the pistons 8a, 8b move with the shaft executing an oscillating rotary movement. A housing 9 laterally enclosing the container 6 is connected to the flange 4. In the assembled position of the pump, stationary segments 10a, 10b, (in the embodiment of FIG. 1, there are two of each such segments) are located between the oscillating segment-shaped pistons 8a and 8b. The segment-shaped pistons are more accurately parts of an annulus about the container 6. The stationary segments 10a, 10b are centered by guide pins extending through the stationary segment from the flange 4 to the end plate 22. The space between the outer surface of the container 6 and the inner surface of the housing 9 forms a pumping space containing the suction spaces 12a, 12b note FIGS. 5a1-5b2. As the segment-shaped pistons 8a and 8b oscillate, they move back and forth between the stationary segments 10a and 10b.

In the above described embodiment, the shape of segments or annular-shaped members was selected for the pistons 8a and 8b, as well as for the stationary parts 10a and 10b. Basically, however, other shapes could also be used.

In the axially extending section of FIG. 1, two pump stages are shown and are set forth in cross-section in FIGS. $5a_1$, $5a_2$, $5b_1$ and $5b_2$. A gas inlet in the end plate 22 connects the first pump stage with the lower pressure side, and the second or last pump stage is connected by a gas outlet with the higher pressure side.

Shaft 1 experiences an oscillating rotary motion due to its connection to the driving unit 7. Such motion is transmitted from the shaft to the container 6 and the segment-shaped pistons 8a, 8b. The pumping space located between the outside surface of the container 6 and the inside surface of the housing is hermetically sealed from the drive means by the hollow member 5 capable of torsional movement. Stationary segments 10a are located in the same axially extending space as the movable segment-shaped pistons 8a, and the stationary segments 10b are located in the same axial section as the movable segment-shaped pistons 8b. The movable pistons 8a, 8b perform an oscillating rotary motion between the stationary segments. As a result, gas is delivered or flows from the inlet 13 to the outlet 14 as a result of the oscillating rotary motion.

The gas to be pumped reaches the suction spaces 12a through the inlet 13 and the gas channels 15. Gas channels 15 are located on the same axis as the guide pins 11. From the channels 15, the gas flows through the inlet valve 16, note FIG. 2. During the compression stroke, the gas is conveyed through the outlet valve 17, the gas channel 18, and the inlet valves of the second stage passing into the second stage. Guide pins 11 close the gas channels between the inlet valve 16 and the outlet valve 17.

The segment-shaped pistons 8a, 8b are arranged in tandem so that an anticyclical motion sequence takes place, that is, as the pumping space in the first stage decreases, the pumping space in the second stage increases. Each half period of the oscillating motion corresponds to a full working cycle.

The individual steps of the pumping action are shown in FIGS. $5a_1$, $5a_2$, $5b_1$ and $5b_2$.

If the pistons 8a are in the position shown in FIG. $5a_1$ at the instant $t_1$, gas to be pumped enters into the suction spaces 12a through the inlet valve 16. At this same instant, the pistons 8b of the second pump stage are in the position shown in FIG. $5b_1$.

At the instant $t_2$, the pistons 8a are in the position shown in FIG. $5a_2$. Correspondingly, the pistons 8b of the second pump stage are in the position shown in FIG. $5b_2$.

The gas in the suction spaces 12a of the first stage is compressed by the piston movement and conveyed through the outlet valve 17, the gas channels 18, and the inlet valves of the second stage into the suction spaces 12b of the second stage.

Figure 3:
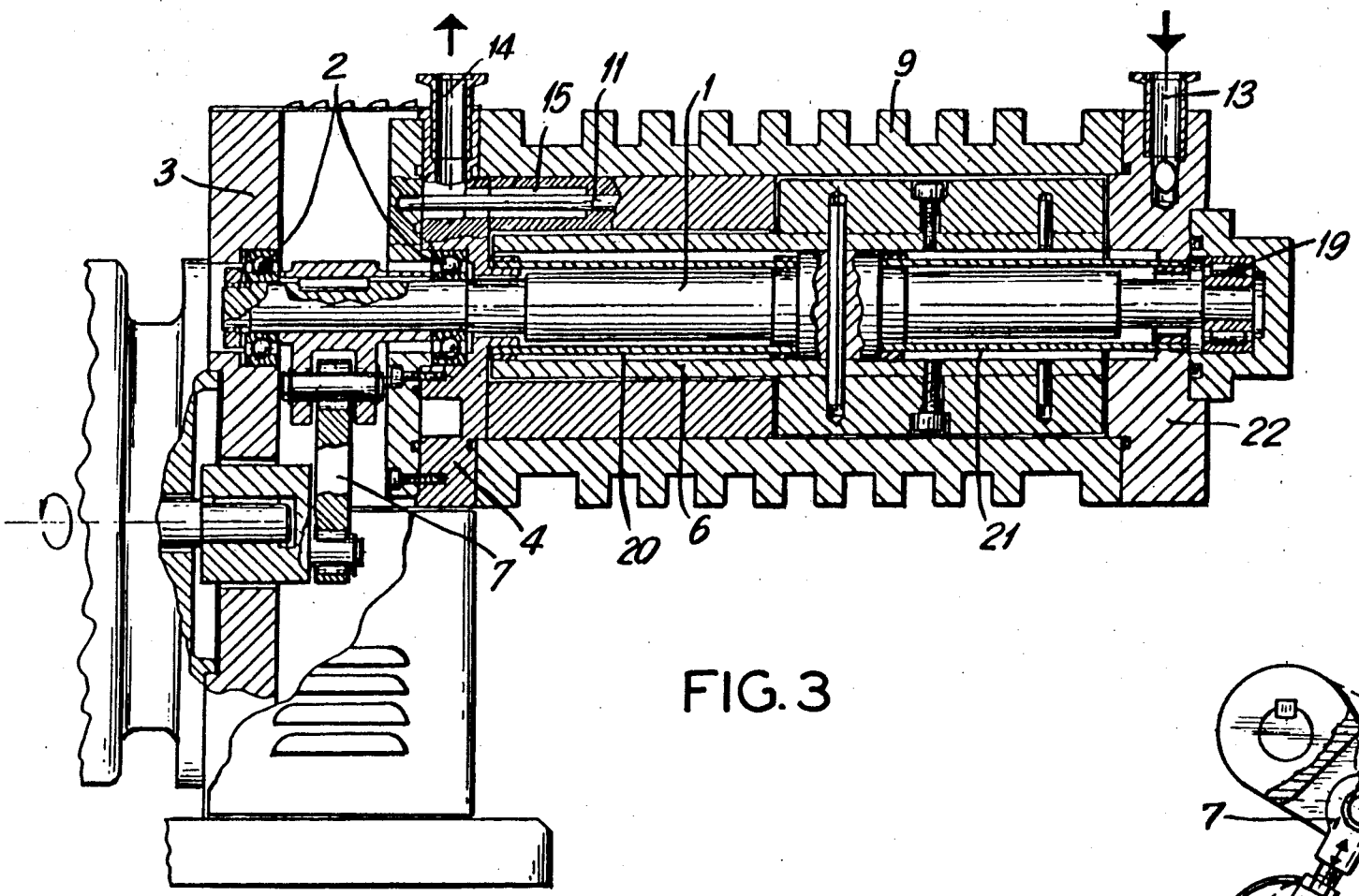
FIG. 3 is an axially extending sectional view similar to FIG. 1, illustrating another embodiment of the present invention.

Another embodiment of the invention is displayed in FIG. 3. In this embodiment, the shaft 1 is no longer supported only at one end in a cantilevered manner, rather an additional bearing 19 is located at the other end of the shaft within the end plate 22. Accordingly, the hollow member 5 capable of torsional movement is divided into two axially extending parts 20 and 21. In this embodiment, the shaft is guided more accurately and tighter gaps are possible in the pumping space.

The number of the segment-shaped pistons and thus the number of the suction spaces, as well as the number of the pump stages, can be varied. It is especially advantageous to vary the number of the segment-shaped pistons from stage to stage to achieve optimized pumping properties.

While specific embodiments of the invention have been shown and described in detail to illustrate the application of the inventive principles, it will be understood that the invention may be embodied otherwise without departing from such principles.

I claim:

1. Pump for conveying gases and providing a differential pressure between a pump inlet and a pump outlet, comprising an axially elongated shaft (I) having a first end and a second end, a drive unit (7) connected to said first end, said drive unit imparting an oscillating rotary motion to said shaft about the axis thereof, wherein the improvement comprises that said shaft (1) is enclosed by a container (6) elongated in the direction of said shaft and spaced outwardly therefrom, said container is connected to said shaft, said container has an inner surface and an outer surface, means in combination with said container for forming a pumping space extending outwardly from the outer surface of said container and in the axial direction thereof, a hollow member (5) capable of torsional movement encircles said shaft and is located between the inner surface of said container and said shaft for forming a hermetic seal between said drive shaft and said pumping space.

2. Pump, as set forth in claim 1, wherein said shaft (1) is supported at the first end thereof in a cantilevered manner, said container (6) is closed at one end and at the closed end is connected to the second end of said shaft, said hollow member is connected at the second end to the shaft in a vacuum sealed manner and is connected with a flange adjacent the first end of said shaft in a vacuum sealed manner and bearing means (2) supporting said first end of said shaft spaced axially from the connection of said tubular member (5) and said flange.

3. Pump, as set forth in claim 1, wherein said shaft (1) is supported at said first end and second end, said container (6) is fastened to said shaft at a location centered between the first and second ends, said hollow member (5) comprises two serially arranged parts (20, 21), one end of each of said parts is connected to said shaft at a location centered between the first and second ends of said shaft and each of said parts (20, 21) is connected in a vacuum tight manner at another end to a flange at the first end of said shaft or to a flange at the second end of said shaft.

4. Pump, as set forth in claims 1, 2 or 3, wherein pistons (8*a*, 8*b*) are connected to and extend outwardly from the outer surface of said container and are located within said pumping space, stationary parts (10*a*, 10*b*) are located within said pumping space between said pistons (8*a*, 8*b*), and said pumping space is divided into suction spaces (12*a*, 12*b*) located between said pistons (8*a*, 8*b*) and said stationary parts (10*a*, 10*b*).

5. Pump, as set forth in claim 4, wherein said pistons (8*a*, 8*b*) and said stationary parts (10*a*, 10*b*) are segment-shaped.

6. Pump, as set forth in claim 4, wherein gas inlet valves (16) and gas outlet valves (17) are located in said stationary parts (10*a*, 10*b*) for conveying gas to be pumped into and out of said suction spaces (12*a*, 12*b*).

* * * * *

UNITES STATES PATENT AND TRADEMARK OFFICE

CERTIFICATE OF CORRECTION

PATENT NO. : 5,017,106

DATED : May 21, 1991

INVENTOR(S) : Kurt Hölss

It is certified that error appears in the above-identified patent and that said Letters Patent is hereby corrected as shown below:

On the title page: Item [73] Assignee should read --Arthur Pfeiffer Vakuumtechnik Wetzlar GmbH, Fed. Rep. of Germany--.

Signed and Sealed this

Twenty-seventh Day of April, 1993

*Attest:*

MICHAEL K. KIRK

*Attesting Officer*

*Acting Commissioner of Patents and Trademarks*